US005365748A

United States Patent [19]

Li

[11] Patent Number: 5,365,748

[45] Date of Patent: Nov. 22, 1994

[54] SCREW COMPRESSOR ICE MAKING PACKAGED UNIT

[76] Inventor: Guangjing Li, B8-9/F., Causeway Centre, Wanchai, Hong Kong

[21] Appl. No.: 166,604

[22] Filed: Dec. 13, 1993

Related U.S. Application Data

[63] Continuation of Ser. No. 962,943, Oct. 19, 1992, abandoned.

[30] Foreign Application Priority Data

Oct. 23, 1991 [CN] China ..... 91108085.6

[51] Int. Cl.[5] ..... F25C 3/02

[52] U.S. Cl. ..... 62/235; 62/503

[58] Field of Search ..... 62/235, 503, 512

[56] References Cited

U.S. PATENT DOCUMENTS 2,096,065 10/1937 Ruppricht ..... 62/512 X
2,466,863 4/1949 Phillips ..... 62/512 X
2,554,920 5/1951 Phillips ..... 62/503 X
2,691,873 10/1954 Skoli et al. ..... 62/503 X
2,952,137 9/1960 Watkins ..... 62/503 X
3,118,290 1/1964 Weller ..... 62/512 X
4,319,462 3/1982 Foster ..... 62/235
4,514,992 5/1985 Holmsten ..... 62/235

*Primary Examiner*—William E. Tapoical
*Attorney, Agent, or Firm*—Fish & Richardson

[57] ABSTRACT

A screw compressor ice making packaged unit comprises a horizontal low pressure refrigerant receiver, at least one screw compressor which is on top of the receiver and parallel thereto, two refrigerant liquid supply installations, two horizontal high pressure refrigerant vessels provided at the exterior of the supply installations, and refrigerant system pipe lines connecting all parts of the set. The central axes of the compressor, low pressure refrigerant receiver together with the supply installations and the high pressure refrigerant vessels are disposed in three levels of upper, middle and lower, and are basically lined up in the same vertical plane. All parts of the same group are arranged symmetrically with respect to the middle perpendicular plane of the ice making packaged unit.

7 Claims, 10 Drawing Sheets

SCREW COMPRESSOR ICE MAKING PACKAGED UNIT

This is a continuation of application Ser. No. 07/962,943, filed Oct. 19, 1992, now abandoned.

BACKGROUND OF THE INVENTION

This invention relates to a screw compressor ice making systems for use in ice making plants of direct expansion type artificial skating rinks using R22 ($CHF_2Cl$), R502 and R717 ($NH_3$) as refrigerant.

In the past, artificial skating rinks have used indirect refrigeration systems to make ice. In these systems, a secondary refrigerant such as brine or glycerine is cooled to a temperature below the freezing point of water through direct expansion of a primary refrigerant in an evaporator. This secondary refrigerant is then pumped to the rink piping system to make ice. Because indirect refrigeration systems rely on the temperature difference between the secondary refrigerant and the skating rink to remove heat for ice making, they are inefficient and consume a lot of electricity. Also, the surface of the ice in rinks using these systems is easy to melt because the amount of heat conduction is limited by the temperature differential between the secondary refrigerant and the rink.

Modern artificial skating rinks usually use direct expansion refrigeration for ice making. In these systems, a refrigerant liquid, such as freon or ammonia, flows directly in the rink piping system. Heat is transferred from the ice to the refrigerant because of the temperature difference between the refrigerant and the ice layer, and because of the latent heat attendant to a phase change of the refrigerant from the liquid to the gaseous state. Direct systems use 45% to 60% less electrical energy compared with indirect refrigeration systems. Also, if there is sufficient refrigerant liquid inside the rink piping system, the refrigerant liquid can evaporate and absorb heat at any time thereby making the surface of the rink harder to melt.

Ice making systems for artificial skating rinks generally use open-type reciprocating compressors rather than semi-hermetic screw-type compressors. These systems are generally put together in a disorderly fashion, and, although some ice making systems come as packaged units, they are not put in single rows nor in symmetrical arrangements. Packaged units which do employ screw compressors often have them installed in the middle or the lower position rather than in the upper-most position. These units have high shipping costs because they are bulky and cannot be transported in a container. These units also increase the total building costs of a rink because they occupy a large floor area.

SUMMARY OF THE INVENTION

According to the invention, a screw compressor ice making unit has a refrigerant receiver for storing and circulating low pressure and low temperature refrigerant liquid, at least one screw compressor on top of the refrigerant receiver and parallel thereto, two refrigerant liquid supply installations arranged symmetrically and centrally below the refrigerant receiver, two refrigerant vessels arranged symmetrically at the ends of the refrigerant liquid supply installations and refrigerant system pipe lines for connecting all the parts also arranged symmetrically. The central axes of the screw compressor, horizontal low pressure refrigerant receiver together with the refrigerant liquid supply installations and horizontal high pressure refrigerant vessels are disposed in upper, middle and lower levels, and are basically lined up in the same vertical plane. All these parts of the same kind are arranged symmetrically with respect to the middle perpendicular plane of the ice making packaged units.

It is an object of this invention to provide a novel screw compressor ice making unit with increased efficiency due to direct expansion refrigeration, having a drastically reduced size because of a single row arrangement, and which can be packed into a container for shipping, thus greatly simplifying the on-site construction of the rink, and providing savings on land and buildings by reducing the floor area required for the ice making plant.

Other features, objects and advantages of the invention will become apparent from the following detailed description when read in connection with the accompanying drawings.

DESCRIPTION OF THE PREFERRED EMBODIMENTS

Referring generally to FIGS. 1–8, a number of steel support plates 39 are provided to support the horizontal vessel bodies 1–4 of the ice making unit.

Figure 1:
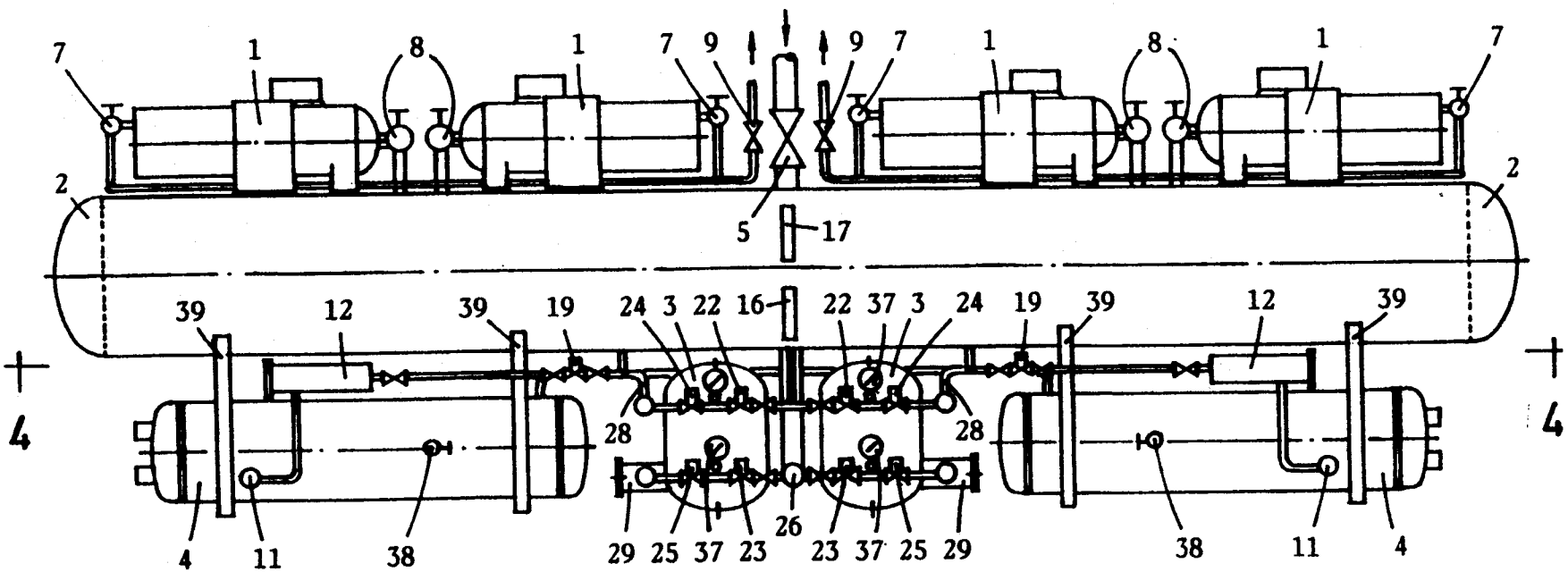
FIG. 1 is a schematic view of a screw compressor ice making packaged unit according to an embodiment of the invention, in which semi-hermetic screw compressors, liquid supply pumper drums and high pressure receivers are installed.
Figure 2:
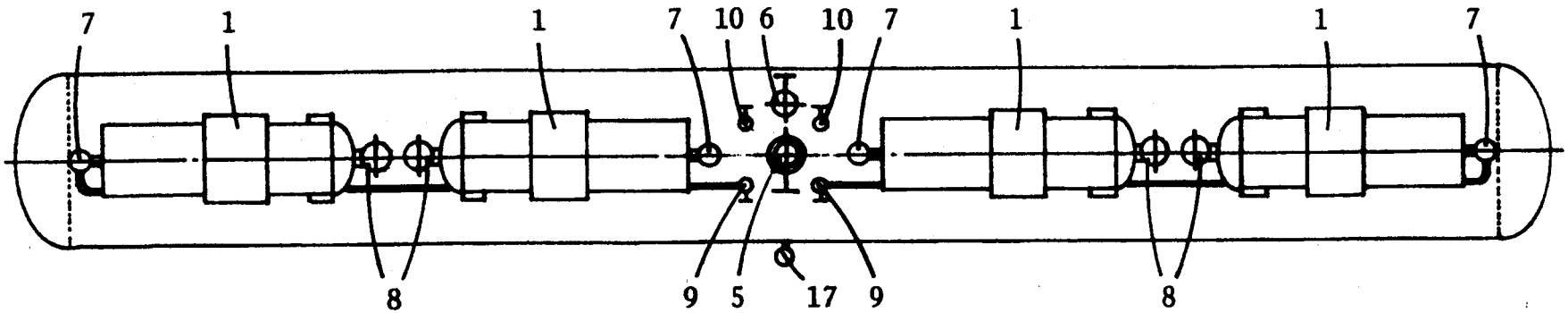
FIG. 2 is a top view of the unit shown in FIG. 1.
Figure 5:
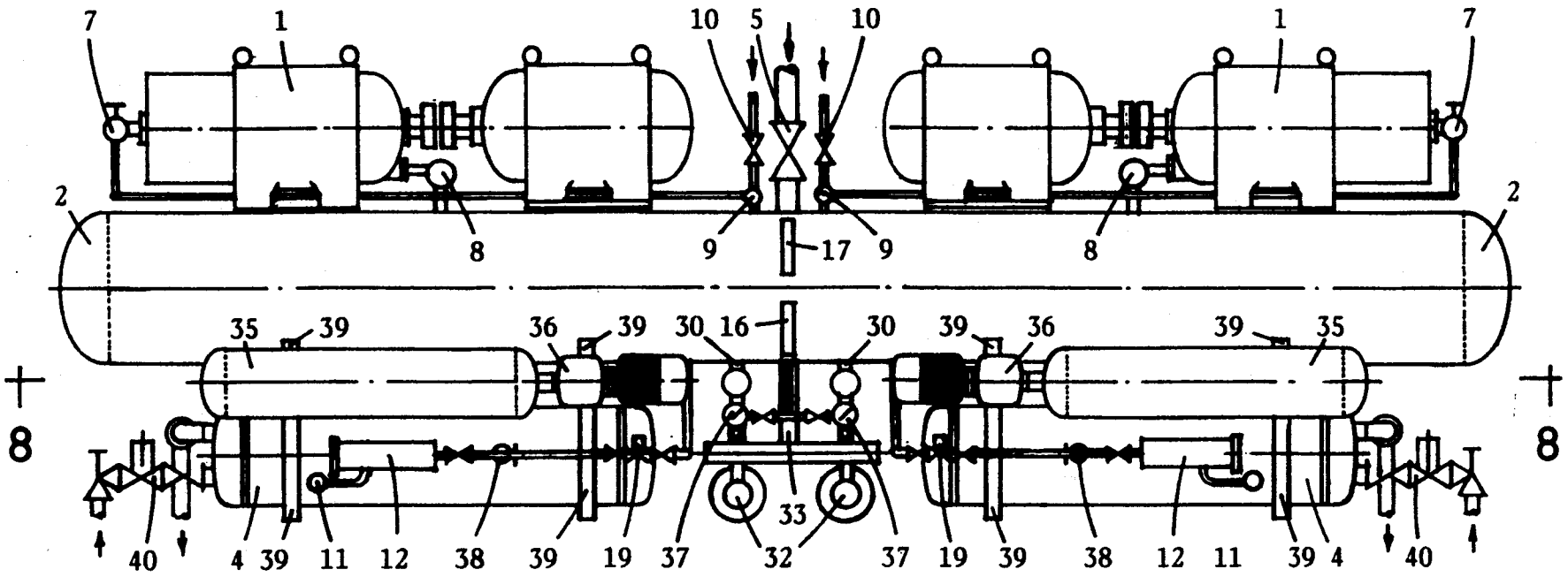
FIG. 5 is a schematic view of a compressor ice making packaged unit according to another embodiment of the invention, in which an open type screw compressors, hermetic refrigerant liquid supply pumps and water cooled condensers are installed.
Figure 6:
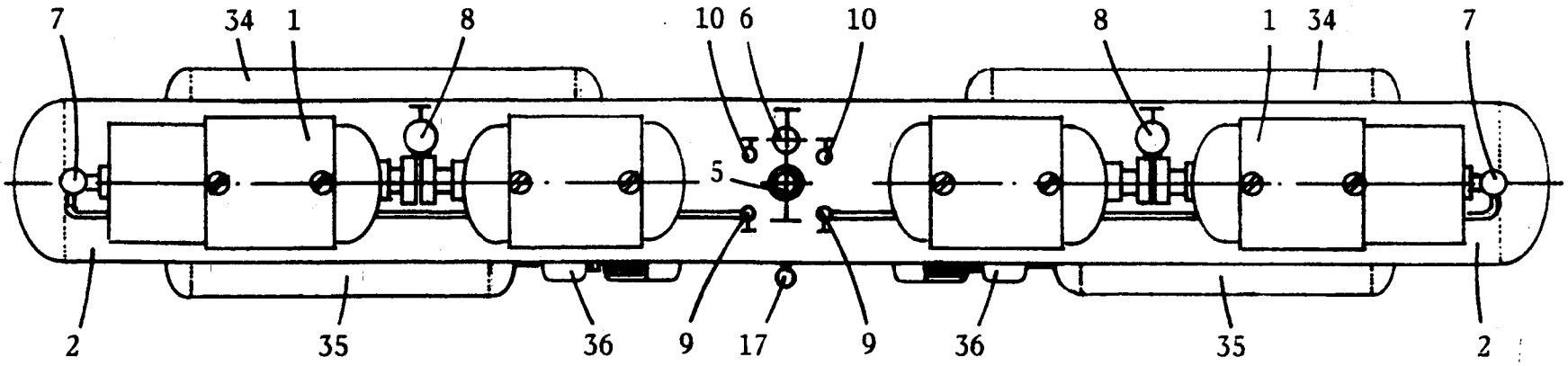
FIG. 6 is a top view of the unit shown in FIG. 5.

Referring now to FIGS. 1 and 5, a horizontal, low pressure, refrigerant receiver 2 is provided for storing and circulating low pressure and temperature refrigerant. Two or four freon ammonia screw compressors 1 are located on top of and parallel to refrigerant receiver 2. Two refrigerant and oil separators 34, two oil coolers 35 and two oil pumps 36 are horizontally installed obliquely below the two sides of refrigerant receiver 2. Refrigerant and oil separators 34, oil coolers 35 and oil pumps 36 are individually symmetrically arranged on the ice making packaged unit.

Referring generally to FIG. 5, because open type screw type compressors are quite long, to keep the length of the system down, only two symmetrically arranged compressors are used for both the freon and ammonia systems. The ice making capacity of each of these screw compressors 1 should be larger than or equal to the amount required to maintain the maximum cooling load maintenance requirement for operating the rink during the hottest season, known as the operating cooling load. One of compressor is used for operation and the other is kept on stand-by.

Referring generally to FIG. 1, semi-hermetic screw compressors are used only with freon because ammonia semi-hermetic condensers currently available will not fit. Four semi-hermetic screw compressors are installed to increase the total equipment cooling capacity of the ice making packaged unit, but operation of three screw compressors should be sufficient to meet the operating cooling load. The fourth screw compressor is used as a stand by compressor and should have only a cooling capacity equal to 33% of the operating cooling load. It is easier to adjust the cooling capacity of a unit with four semi-hermetic screw compressors to a change in the operating cooling load of the rink, thus the capital investment and daily operating costs are lower.

Refrigeration Cycle

Figure 9:
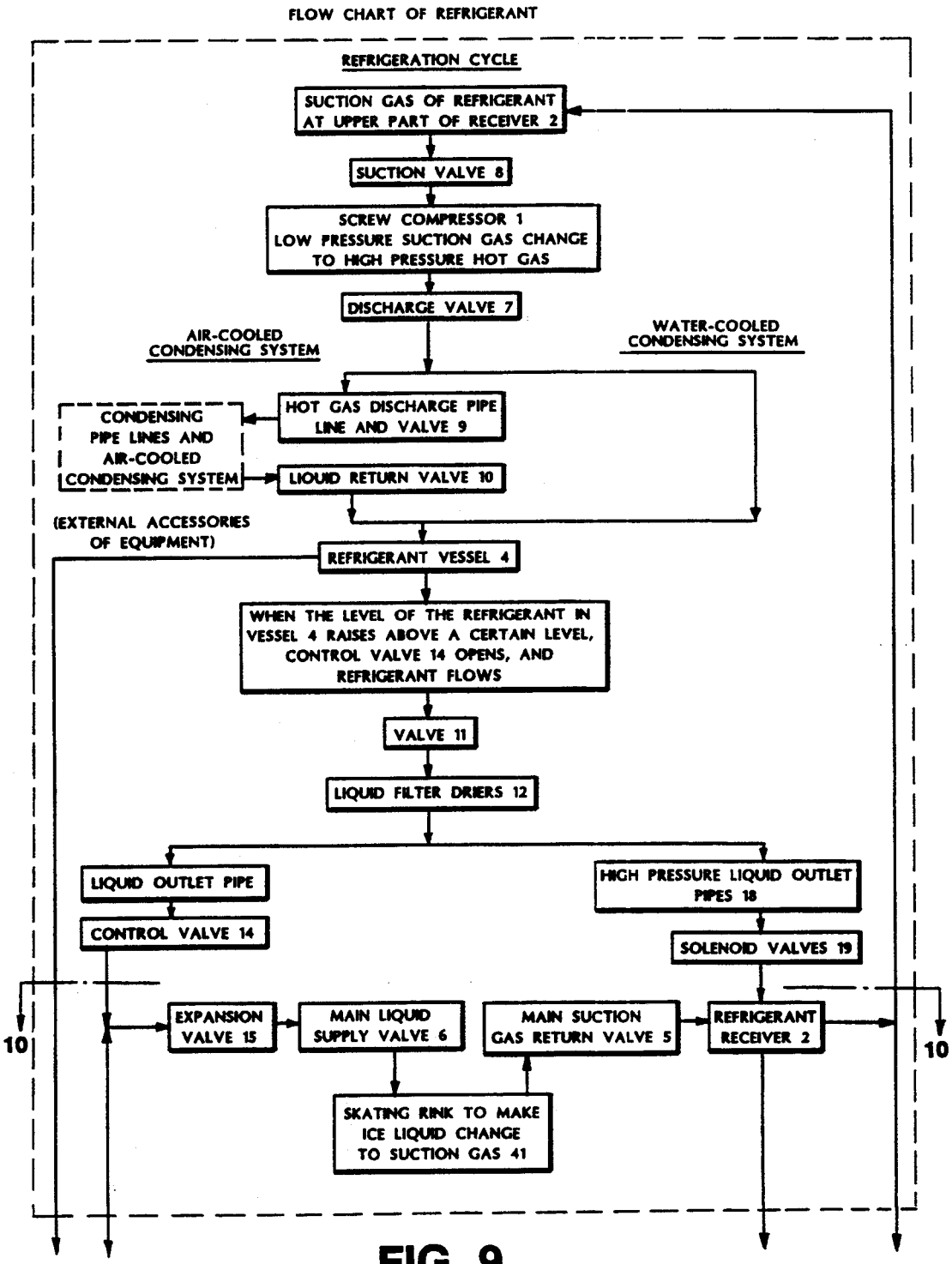
FIG. 9 is a flow chart of the refrigerant in the refrigeration cycle.

Referring additionally to FIG. 9, gaseous refrigerant having low pressure and low temperature is sucked from refrigeration receiver 2 into screw compressor 1 through suction valve 8 of screw compressor 1. Screw compressor 1 compresses the gaseous refrigerant from a low pressure and low temperature into a high pressure and high temperature, and this high pressure and high temperature refrigerant gas is discharged through discharge valve 7 of screw compressor 1.

If the ice making system uses an air cooled condensing system, the high pressure and high temperature gas passes through a gas discharge pipe line and valve 9 and goes up to the condensing pipe lines and the air cooled condensing equipment (not shown) located outside the ice making unit. The high pressure and high temperature refrigerant gas condenses as it cools, and becomes a high pressure and normal temperature liquid. This liquid flows back to the ice making unit through liquid return valve 10 and into refrigerant vessel 4 for storage.

Figure 8:
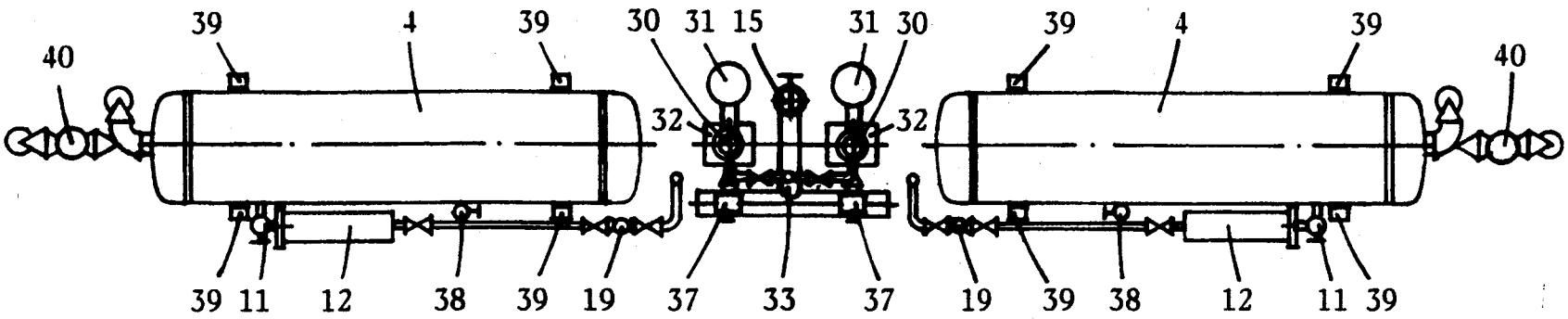
FIG. 8 is a sectional view along line 8—8 of FIG. 5.

If the ice making system uses a water cooled condensing system, discharge valve 9 and liquid return valve 10 are not necessary. The high pressure and high temperature gas is discharged through discharge valve 7 of the screw compressor 1 and is discharged directly into refrigerant vessel 4. Thus, in an air cooled condensing system, refrigerant vessel 4 functions as a high pressure receiver, and in a water cooled condensing system, refrigerant vessel 4 functions as a water cooled condenser and a high pressure receiver. As shown in FIGS. 5 and 8, condensing water pump 40 circulates cooling water to high pressure refrigerant vessel 4 which works as a water cooled condenser and high pressure receiver in the water cooled condensing system, with its auxiliary function as a receiver of high temperature refrigerant gas and its main function as a condenser of that high temperature refrigerant gas.

Figure 4:
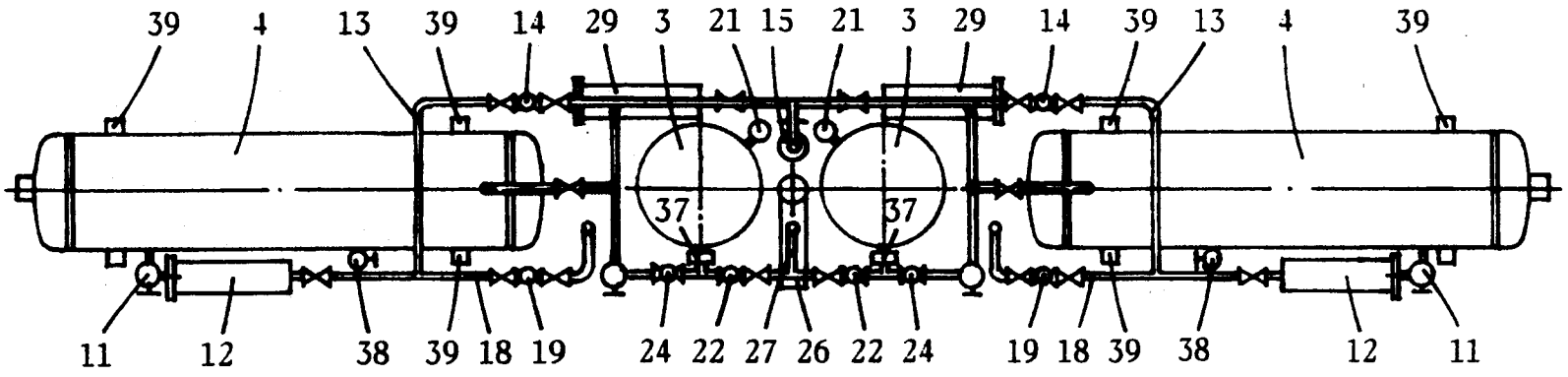
FIG. 4 is a sectional view along line 4—4 of FIG. 1.

Referring now to FIG. 4, the level of high pressure and normal temperature refrigerant liquid stored in refrigerant vessels 4 is controlled by liquid level regulators attached thereto (not shown). When the level of refrigerant in refrigerant vessels 4 has reached an upper limit, control valves 14 automatically open allowing refrigerant to discharge under its own pressure from refrigerant vessel 4 through valves 11, liquid filter driers 12, liquid outlet pipes 13, control valves 14 and expansion valves 15. After the pressure is reduced at valve 15, the refrigerant flows as shown in FIG. 9 through main liquid supply valves 6 directly into the liquid supply header of the rink 41 for ice making.

After control valves 14 open allowing refrigerant to discharge under its own pressure from refrigerant vessel 4, the refrigerant can also pass through high pressure liquid outlet pipes 18 and solenoid valves 19 and enter refrigerant receiver 2. Solenoid valves 19 are controlled by lower liquid level regulators 16 in the lower middle part of refrigerant receiver 2 and allow for automatic regulation of the level of refrigerant in refrigerant receiver 2.

Low pressure and low temperature refrigerant liquid returns from the ice making system and passes through main suction gas return valve 5 into refrigerant receiver 2. When the level of the liquid in refrigerant receiver 2 rises to an limit, upper liquid level regulator 17 installed in the upper middle part of refrigerant receiver 2 will automatically stop the operation of screw compressor 1 to prevent refrigerant liquid from being sucked into the screw compressor 1 and causing damage.

When the low pressure and low temperature liquid in refrigerant receiver 2 coming from the ice making system has changed phase from a liquid to gas due to heat absorption, it is passed into screw compressor 1 thereby completing the refrigeration cycle.

Liquid Supply Cycle

Figure 10:
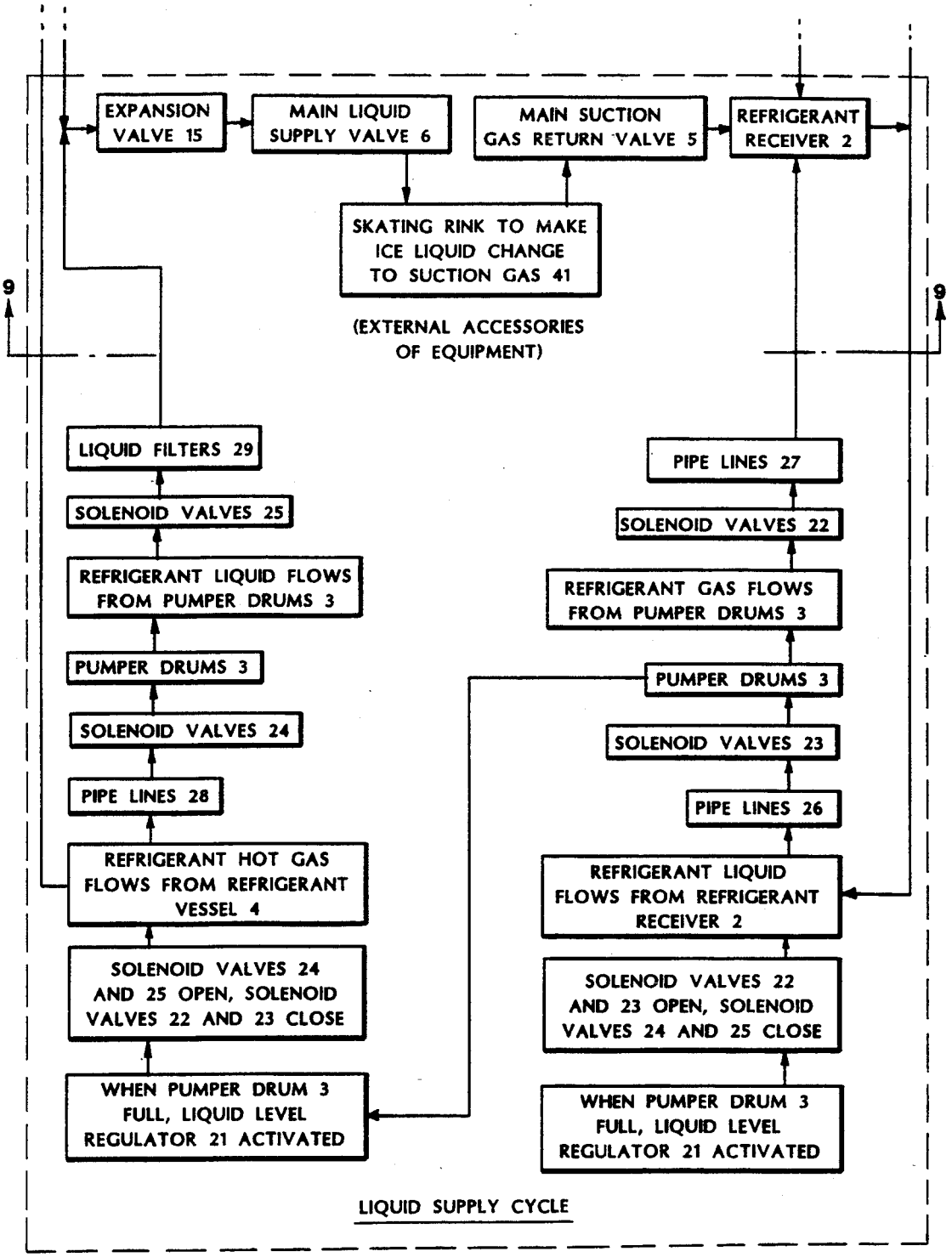
FIG. 10 is a flow chart of the refrigerant in the ice making cycle.

Referring additionally to FIG. 10, solenoid valves 22 and 23 are controlled by liquid level regulator 20. When there is no low pressure and low temperature refrigerant liquid in liquid supply pumper drums 3, solenoid valves 22 and 23 will automatically open at the same time. Gravity will pull the low pressure and low temperature liquid from refrigerant receiver 2 through main pipes 26 and solenoid valves 23 into the lower part of liquid supply pumper drums 3. The residual low pressure and low temperature refrigerant gas in liquid supply pumper drums 3 will be displaced upwardly by the inflow of the low pressure and low temperature liquid and will enter refrigerant receiver 2 through solenoid valves 22 on pipe lines 27.

When liquid supply pumper drums 3 is filled with low pressure and low temperature liquid, solenoid valves 22 and 23, as controlled by liquid level regulators 21, will automatically and simultaneously close. Another pair of solenoid valves 24 and 25 will automatically and simultaneously open to cause high pressure and normal temperature gas from refrigerant vessel 4 to pass through pipe lines 28 and solenoid valves 24 and enter liquid supply pumper drums 3. As the pressure in the liquid supply pumper drums 3 increases, the low pressure low temperature liquid in liquid supply pumper drum 3 is pushed through solenoid valves 25, liquid filters 29, expansion valves 15, main liquid supply valves 6, and into liquid supply header of the rink (not shown) for ice making.

When the low pressure and low temperature liquid in liquid supply pumper drums 3 is exhausted, liquid supply pumper drum will repeat the above described processes to intermittently supply liquid refrigerant to the piping of the skating rink 41.

When the low pressure and low temperature liquid in the refrigeration piping of the skating rink 41 has absorbed heat from outside and some of the liquid has evaporated, the liquid-gas mixture will pass through the suction gas header (not shown) and main suction gas return valve 5 of the ice making unit and will be sucked back into refrigerant receiver 2. The low pressure and low temperature gas in refrigerant receiver 2 will be sucked into screw compressor 1 and the low pressure and low temperature liquid will be stored in refrigerant receiver 2.

As shown in FIG. 5, the ice making unit may use hermetic refrigerant liquid supply pumps 32 instead of liquid supply pumper drums 3 to supply the liquid. The low pressure and low temperature liquid in refrigerant receiver 2 is pumped by supply pumps 32 through liquid outlet pipe 30 of refrigerant receiver 2. The liquid then flows through liquid filters 31 and is discharged into main liquid supply pipes 33 of the ice making unit. This liquid then flows through the main liquid supply valve 6 into the liquid supply header of the skating rink 41. The other functions of hermetic liquid refrigerant supply pumps 32 are similar in principle to those of liquid supply pumper drum 3.

When the ice making unit is installed at a higher elevation than the rink piping system, the low pressure and low temperature liquid in refrigerant receiver 2 may utilize gravity to cause the refrigerant to flow into the rink piping system 41. Under these conditions, the refrigerant vessel 4 and either liquid supply pumper drums 3 or supply pumps 32 are not necessary and the refrigerant flows directly from refrigerant receiver 2 to the rink piping system. This makes the dimension of the ice making unit smaller, and the system much tidier.

Safety Installations

Safety valve 38 on refrigerant vessel 4 is set to automatically open when the pressure inside refrigerant vessel 4 reaches a certain level. When safety valve 38 opens, an amount of refrigerant is discharged through the pipe lines (not shown) to refrigerant receiver 2. Vacuum gage and thermometer 37 are provided to monitor the pressure and temperature of the refrigerant.

The screw compressor ice making unit of the present invention has one tenth as many parts as the old reciprocating compressor. The screw compressor also vibrates very little, makes little noise, has higher efficiency and saves more space.

Because of the adoption of an integral type construction, the ice making packaged unit of this invention can combine many devices into an integral unit. When it has been transported to the construction site of the rink, it can be put into operation as soon as it is connected to the pipe lines and the electrical system of the site of the rink. This will drastically reduce the amount of work and the period of construction. As the packaged unit can be prefabricated and processed in the factory, the precision and quality of the entire refrigeration system can be improved.

Figure 3:
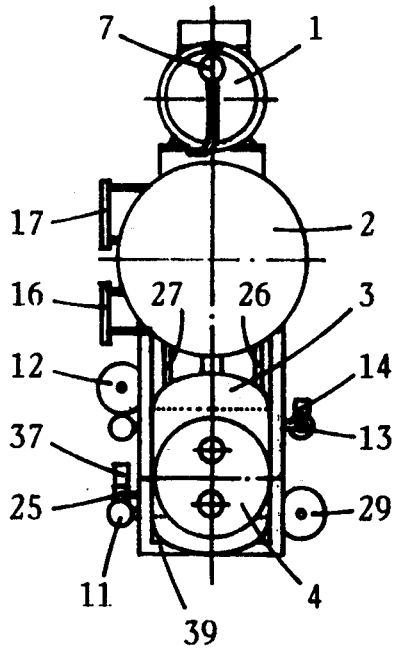
FIG. 3 is a left side view of FIG. 1.
Figure 7:
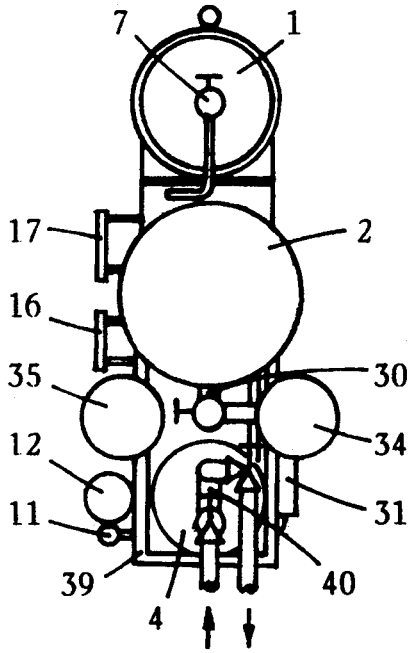
FIG. 7 is a right side view of FIG. 5.

Referring now to FIGS. 3 and 7, screw compressor 1 is mounted on top of refrigerant receiver 2, and the central axes of all the main parts are arranged symmetrically in the same vertical plane (not shown). This symmetrical arrangement makes the entire unit very compact. It is also easy to perform maintenance work on both sides of all parts, and easy to pack in a container for transportation which reduces freight costs. Because the dimension of the packaged unit are small, the unit can greatly reduce the floor area occupied by the ice making plant room, and greatly reduce the land and construction costs. In a preferred embodiment, the width of the ice making unit is roughly 1 meter, therefore, an independent refrigerant plant room may not be necessary because the ice making packaged unit could be installed in a pit beneath the skating rink. The compound ice making unit of the invention may also be especially suitable for mobile or temporary rinks.

What is claimed is:

1. A screw compressor ice making packaged unit comprising:
   - a horizontal low pressure refrigerant receiver used for storing and circulating low pressure and low temperature refrigerant liquid;
   - at least a screw compressor mounted on top of the horizontal low pressure refrigerant receiver and parallel thereto;
   - two refrigerant liquid supply installations arranged symmetrically at the central position underneath said horizontal low pressure refrigerant receiver;
   - two horizontal high pressure refrigerant vessels arranged symmetrically at the exterior of the refrigerant liquid supply installations;
   - refrigerant system pipe lines for connecting all the parts arranged symmetrically;
   - the central axes of said screw compressor, horizontal low pressure refrigerant receiver together with the refrigerant liquid supply installations and horizontal high pressure refrigerant vessels being disposed in upper, middle and lower levels, and being basically lined up in the same vertical plane, all said parts of the same group being arranged symmetrically with respect to the middle perpendicular plane of the ice making packaged unit.

2. The screw compressor ice making packaged unit according to claim 1 wherein said supply installations of refrigerant are liquid supply drums.

3. The screw compressor ice making packaged unit according to claim 1 wherein said supply installations of refrigerant are liquid supply pumps.

4. The screw compressor ice making packaged unit according to claim 1 wherein said horizontal high pressure refrigerant vessels are water cooled condensers.

5. The screw compressor ice making packaged unit according to claim 1 wherein said horizontal high pressure refrigerant vessels are high pressure receivers.

6. The screw compressor ice making packaged unit according to any one of claims 1 to 4 or 5 wherein said screw compressors are four units of semi-hermetic screw compressor for freon refrigerant.

7. The screw compressor ice making packaged unit according to any one of claims 1 to 4 or 5 wherein said screw compressors are two units of open type compressor for freon or ammonia refrigerant.

* * * * *